US005609477A

United States Patent [19]

Saurwein

[11] Patent Number: 5,609,477

[45] Date of Patent: Mar. 11, 1997

[54] INLET/OUTLET VALVE ARRANGEMENT FOR A FLUID PRESSURE INTENSIFYING APPARATUS

[75] Inventor: Albert C. Saurwein, Granger, Wash.

[73] Assignee: Forgesharp Limited, Cleveland, England

[21] Appl. No.: 335,807

[22] PCT Filed: Mar. 12, 1993

[86] PCT No.: PCT/US93/02379

§ 371 Date: Nov. 14, 1994

§ 102(e) Date: Nov. 14, 1994

[87] PCT Pub. No.: WO94/20754

PCT Pub. Date: Sep. 15, 1994

[51] Int. Cl.[6] ..... F04B 53/10

[52] U.S. Cl. ..... 417/567; 417/571; 137/539.5

[58] Field of Search ..... 417/403, 567, 417/571; 137/539.5

[56] References Cited

U.S. PATENT DOCUMENTS

| | | | |
|---|---|---|---|
| 3,309,013 | 3/1967 | Bauer | 417/571 |
| 3,309,014 | 3/1967 | Bauer et al. | 417/567 |
| 3,526,246 | 9/1970 | Leitgeb . | |
| 3,702,624 | 11/1972 | Fries . | |
| 4,412,792 | 11/1983 | LaBorde et al. | 417/571 |
| 4,747,758 | 5/1988 | Saurwein . | |
| 4,818,194 | 4/1989 | Saurwein . | |
| 4,820,136 | 4/1989 | Saurwein . | |
| 4,848,671 | 7/1989 | Saurwein . | |
| 4,862,911 | 9/1989 | Yie | 417/571 X |
| 4,973,026 | 11/1990 | Saurwein . | |
| 5,037,276 | 8/1991 | Tremoulet, Jr. | 417/567 |

*Primary Examiner*—Timothy Thorpe
*Assistant Examiner*—Roland G. McAndrews, Jr.
*Attorney, Agent, or Firm*—Pollock, Vande Sande & Priddy

[57] ABSTRACT

A fluid pressure-intensifying apparatus of the double-acting type has end check valve assemblies (25, 25*a*). Each assembly has an inner low pressure poppet (100) communicable with the high pressure chamber (30) of the apparatus, and an outer high pressure ball poppet (110) communicable with a high pressure fluid outlet line (57). The check valve assembly (25) is designed for service accessibility without having to dismantle the intensifier. The apparatus includes a cylindrical housing (10) within which low and high pressure piston assemblies (28, 30, 30*a*) are confined by threaded end rings (12, 12*a*) under compression.

34 Claims, 2 Drawing Sheets

INLET/OUTLET VALVE ARRANGEMENT FOR A FLUID PRESSURE INTENSIFYING APPARATUS

RELATED APPLICATION

This is the U.S. national stage application of international application PCT/US93/02379 filed Mar. 12, 1993.

FIELD OF THE INVENTION

This invention relates to high pressure fluid intensifier systems. More particularly, this invention relates to check valve assemblies for controlling fluid flow into and out of the high pressure intensifier chamber.

BACKGROUND OF THE INVENTION

In a typical high pressure fluid intensifier system, hydraulic fluid acts on a reciprocating double-acting, low pressure-high pressure piston assembly to compress water to over several thousand psi. The piston assemblies of such systems are exposed to hydraulic fluid pressures on the order of 2,000 psi and to outlet water pressures on the order of 20–60,000 psi. These assemblies must be designed to withstand tremendous pressure fluctuations while at the same time maintain hydraulic fluid/water separation.

The inlet and outlet valve members of the pressurized fluid check valve assembly and their valve seats are severely stressed. Replacement of the valve members and their seats periodically is difficult because of the attachment of the various members making up the intensifier pressure chambers and piston assembly. Usually, the intensifier must be completely dismantled to reach and repair or replace such internal elements.

In my U.S. Pat. No. , 4,818,194, I describe a check valve assembly that is designed to be accessible for service without dismantling the intensifier appurtenant thereto. In this patent, the check valve assembly is so arranged that the high pressure water outlet portion is provided at the outer end of the assembly adapter. In this design, removal of the adapter exposes the high pressure valve element and its seat for service or replacement. Also in this design, the inner low pressure end of the check valve assembly, which requires service less often, is accessible when the entire assembly is removed from the intensifier. A check valve retainer ring secures the assembly to the intensifier, in this design, and the retainer ring is easily removed so that the check valve assembly can be removed without dismantling the intensifier. When the various parts are serviced or replaced, it is a simple matter, in this design to re-install the check valve assembly in full working condition, without having to be concerned about the relative alignment of the other components that make up the complete intensifier system.

SUMMARY OF THE INVENTION

The check valve assembly of this invention is designed similarly to the assembly described in my U.S. Pat. No. , 4,818,194. A similar valve body and check valve retainer ring concept is employed to secure the check valve mechanism to the intensifier. The operating components within the valve body, however, are different. The internal valve mechanism provided by the present invention comprises a high pressure ball poppet sub-assembly for the outlet flow that is conveniently accessible for service or replacement when the valve body remains installed in the intensifier assembly. This ball poppet configuration could also be a flat poppet type which may be superior in some pressure ranges. A flat poppet and seat open to permit inflow water in the high pressure barrel. The inlet poppet is guided in such a way as to insure nearly perfect parallelism of the sealing surfaces at the instant of contact. This is extremely important as contact of the poppet on an edge prior to flat contact causes heat, erosion, and short life. The internal valve mechanism also is so constructed that the cycling pressure on the high pressure ball poppet sub-assembly during operation is contained within a compressive stress field to reduce the possibility of failure due to fatigue.

DETAILED DESCRIPTION OF THE INVENTION

Figure 1:
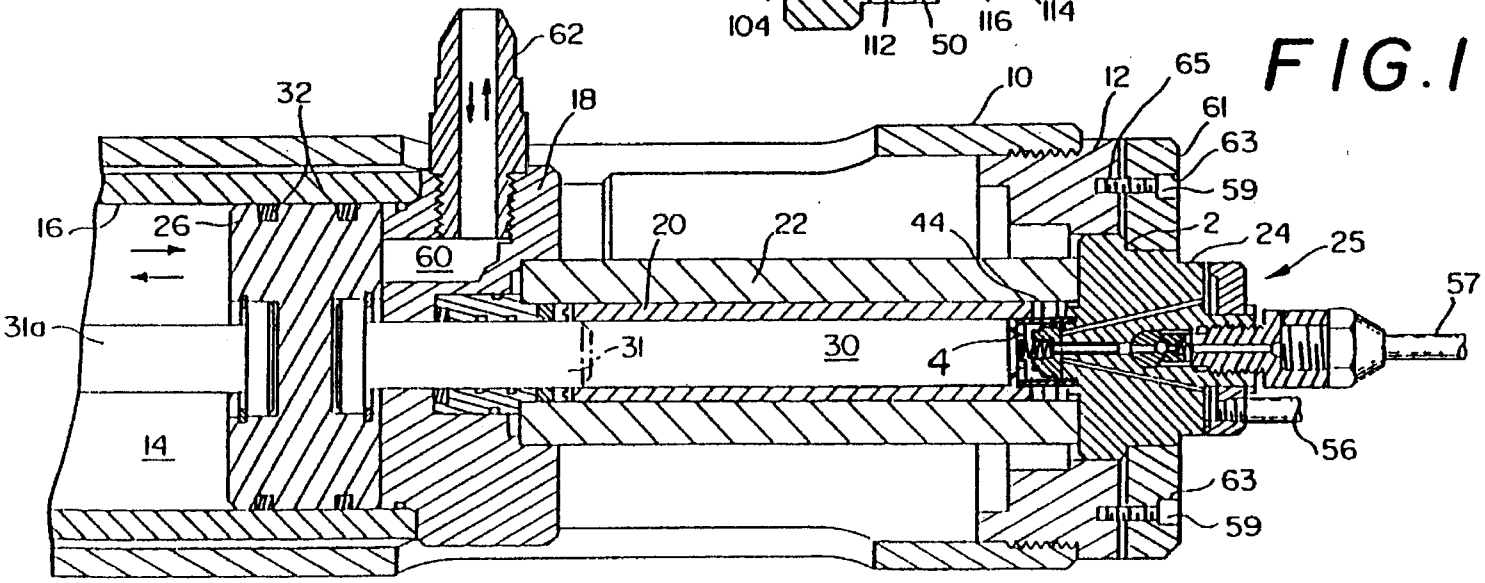
FIG. 1 is a section through the right half of the intensifier assembly illustrating the right hand check valve in place.
Figure 5:
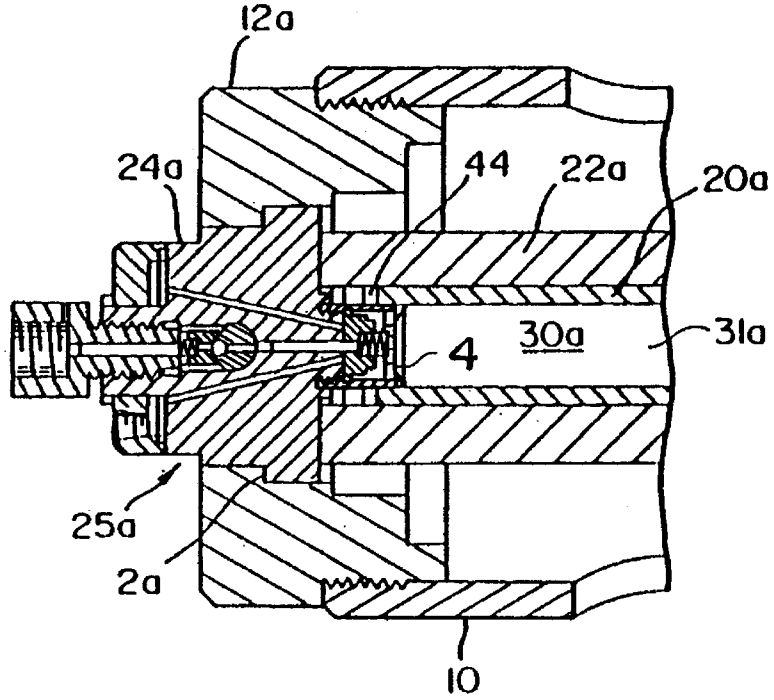
FIG. 5 is a section through the left end of the intensifier assembly illustrating the left hand check valve in place.

An intensifier arrangement utilizes hydraulic working fluid (oil) to drive a high pressure-low pressure piston assembly to produce a high pressure water flow. The intensifier shown in FIGS. 1 and 5 is double-acting. In comprises a housing 10 in the form of an elongated steel cylinder. One half, the right half, is shown in FIG. 1 and the left end is shown in FIG. 5. The left half is a duplicate, a mirror image with the exception for the left hand retainer ring, as will be described and explained hereinafter. This intensifier assembly is described in greater detail in my U.S. Pat. No. 4,747,758, the disclosure of which is hereby incorporated herein by this reference. Each end of the housing mounts an end retainer ring, the right hand retainer ring being designated 12 and the left hand retainer ring 12*a*, the end of housing 10 being internally threaded to mate with external threads on the retainer rings 12, 12*a*. Within housing 10, a low pressure chamber 14 is provided by a steel cylinder 16 fitted onto a cylindrical end cap 18 at each end (the right hand cap being shown; the left hand end cap is an opposite hand duplicate). All within housing 10, a right hand and a left hand high pressure chamber are provided (the right hand high pressure chamber 30 being shown in FIG. 1 and the left hand high pressure chamber 30*a* being shown in FIG. 5), each by an elongated steel barrel cylinder 22, 22*a* fitted at its inner end into end cap 18 and at its outer end onto a valve body 24, 24*a* of an inlet/outlet water check valve assembly 25, 25*a*. Valve body 24, 24*a* is provided with a machined external rim 2, 2*a* which is engaged by a corresponding inner rim of retainer ring 12, 12*a*. A cylinder sleeve or liner 20, 20*a* is confined within the high pressure cylinder 22, 22*a* and defines the cylindrical periphery of the high pressure chamber 30, 30*a*. End retainer ring 12, 12*a*, acting through valve body 24, 24, centers the outer end of cylinder 22, 22*a*, and consequently, the inner liner 30, 30*a*, so that the cylinder rod 31, 31*a* will have an exactly axially-aligned chamber 30, 30*a* within which to reciprocate.

Since the retainer ring 12*a* on the left hand side is fixed, when snugged up to the housing 10, it establishes the proper axial orientation of the high pressure module relative to the housing 10. The right hand retainer ring 12 is snugged up to the right hand end of the housing 10; then a second preload ring 61 with six bolts hole 63, which match six threaded holes 65 in the retainer ring 12, is screwed onto the end of the retainer ring 12. The six bolts 59 are torqued producing a force exerted on the flange of the right hand check valve body 24, transmitted axially through the components of the high pressure module, and seated by the left hand retainer ring 12*a* at the left end of the housing 10. The torque value applied to each of the six preload bolts produces a load greater than that force generated internally by the pressurized water exerted on the area at the end of the high pressure barrel. By this preload method, the components in the stack-up of the high pressure module are forced to maintain contact with each other during each complete cycle of operation, thus in large part preventing gaps between the contacting surfaces of the high pressure components which could allow extrusion of seal material and subsequent seal breakdown and failure. The retainer ring 12*a* on the left hand side is the same geometric configuration as the right hand retainer ring 12 but with a flange projection through which the left hand check valve body 24*a* protrudes. The left hand retainer ring 12*a* has a sufficiently small insider diameter to provide a flat annular area which the shoulder of the left hand check valve body 24*a* can contact and which can react to the preload produced by the preload ring 61 on the right hand side.

The outer surface of end cap 18 conforms to the inner surface of housing cylinder 10, with a small allowance for a slip-fit clearance. Tightening the end of preload ring 61 places the pressure chamber elements in longitudinal compression and the housing cylinder 10 in longitudinal tension. When one or both end retainers are removed, however, these elements may be removed from the housing in a very expeditions manner. The low pressure and high pressure cylinders, 16 and 22, 22*a*, are mounted in axial alignment with the housing cylinder 10 by the end caps 18 and the retainer rings at both ends. Because of the relative dimensions of the elements thus far described, the pressure chamber elements are confined against any lateral or longitudinal movement.

The low pressure-high pressure piston assembly comprises a low pressure piston 26 and left and right hand high pressure pistons 31*a*, 31. The low pressure piston is a cylindrical disk contained with low pressure chamber 14. Its outer surface conforms to the inner surface of low pressure cylinder 16, with a small allowance for a slip-fit clearance, and mounts appropriate hydraulic pressure seals 32 to seal one side of low pressure chamber 14 from the other. The high pressure pistons 31, 31*a*, are ground and polished carbide rods connected to opposite faces of the low pressure piston 26 and extended through the respective cylinder end block 18 into the high pressure chamber sleeve 20, 20*a*.

Reciprocation of the high pressure piston is effected as a consequence of hydraulic working fluid being pumped into low pressure chamber 14 on one side of low pressure piston 26 or the other. Each end cap 18 is ported as at 60 to provide for hydraulic fluid flow into and out of low pressure chamber 14. An inlet tube 62 is screwed into port 60 for connection to a hydraulic fluid supply. When hydraulic fluid is pumped through port 60 into chamber 14, low pressure piston will be driven leftward from the position shown, thus retracting the right hand high pressure piston rod 31 and extending the left hand high pressure piston rod 31*a*. Concurrently, hydraulic fluid will be vented through the hydraulic fluid port in the left hand cylinder block, and water in the left hand high pressure chamber will be compressed and forced out through the left hand valve body 24*a*. When low pressure piston 26 reaches the left end of low pressure chamber 14, hydraulic fluid flow will be reversed and low pressure piston 26 will be driven rightward. Hydraulic fluid will be vented through right hand cylinder block part 60 and water in high pressure chamber 30 will be compressed and forced out through valve body 24.

Now, with respect to the right hand check valve assembly 25 (the left hand check valve assembly being a duplicate and represented by the same numerals with a lower case "a" associated therewith, such as "25*a*" and so forth), the outer end of high pressure cylinder 22, 22*a* fits over a pilot or shoulder that protrudes from the check valve body 24. Valve body 24 is machined to provide a stepped cylindrical pilot 3 for that purpose. A Delrin polycarbonate ring 5 is pressed onto the outer shoulder of the pilot 3 at the inner side of the valve body 24. The face of the ring 5 enters the high pressure barrel 22 and, being softer, prevents damage to the very critical surface finish of the inner bore of the high pressure barrel 22. The end of the pilot is machined to provide a smaller cylindrical end surface which is externally threaded to accept a valve body nose 4 as a seat for a high pressure static seal group 44. The stepped transition between the high pressure cylinder-mounting pilot and the high pressure seal seat afforded by nose 4 provides a metal back-up for seal group 44. The nose 4 restrains the inner edges of the static seal group, and houses the return spring 106 for the low pressure poppet 100 and poppet guide 102.

As high pressure piston rod 31 is retracted from the position shown, low pressure water is drawn into a high pressure chamber 30 through inlet passages 50 in inlet/outlet valve body 24. When piston rod 31 is driven back to the position shown, water is compressed to a high pressure and then forced out through outlet passage 54 in check valve assembly 25. Water flow into and out of high pressure chamber 30 is controlled by water pressure-influenced poppet-type outlet check and inlet valve subassemblies 52 and 53.

Inlet/outlet check valve assembly 25 comprises valve body 24, low pressure water inlet manifold 51 communicating with low pressure water inlet passages 50 through an annular water-distributing interface 55 between the outer face of valved body 24 and the inner face of manifold 51, outlet water poppet subassembly 52, inlet water poppet subassembly 53, high pressure outlet water line adapter 58 communicating with high pressure water outlet passage 54, and manifold lock nut 59 sealing manifold 51 to the valve body 24. The outer end of valve body 24 is externally threaded and manifold lock nut 59 is screwed thereon to water-tightly seal manifold 51 to the outer face of the valve body. Low pressure water inlet line 56 is attached to manifold 51 and high pressure water outlet line 57 is attached to adapter 58. The inner face of manifold 51 is counter bored to provide annulus 55 for distribution of inlet water from inlet line 56 to inlet passages 50.

Figure 2:
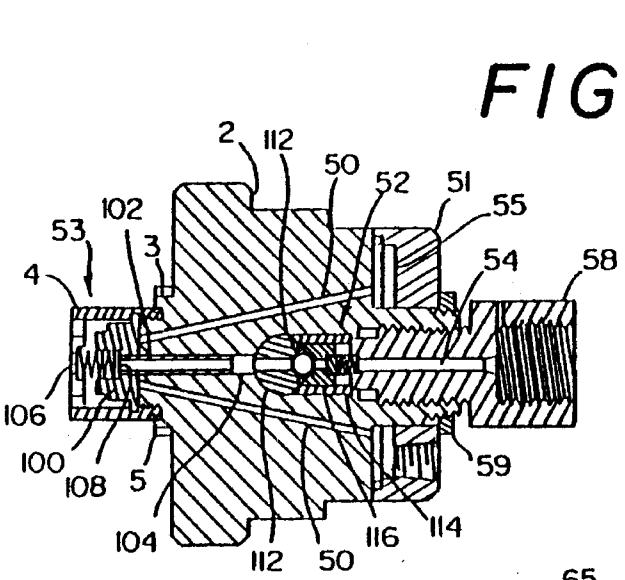
FIG. 2 is an enlarged cross section of the inlet/outlet check valve assembly of this invention.

The check valve assembly, as shown in enlarged detail in FIG. 2, comprises an inlet disk poppet 100, an inlet poppet guide tube 102 inserted into an axial bore 104 extending axially through the valve body 24 as shown, inlet poppet closing spring 106 and nose 4. Inlet water passages 50 are bored through valve body 24 to open at the outer surface of the protrusion, pilot 3, as shown. Inlet disk poppet 100 has a planer inner surface that mates with the circular outer end surface of pilot, or protrusion, 3 to seat thereagainst and seal off the inlet water passages 50. Nose 4 is a metal end cap having a cylindrical inner diameter large enough to permit inlet poppet 100 to reciprocate to and from contact with the pilot end face. The end of the nose cap is bored to provide several apertures for passage of water into and out of the nose 4. The outer end surface of inlet poppet 100 is counterbored to receive a coil compression spring 106, and the inner end of the nose cap is likewise counterbored to receive the opposite end of spring 106. Spring 106 urges inlet poppet against the end face of pilot 3 to seal off the inlet water passage 50. Guide tube 102 is inserted into the valve body outlet water passage 104 and extends through inlet poppet 100 and terminates in a hollow flange 108. Guide tube 102 protrudes from the end face of pilot 3 a sufficient distance that the inlet poppet can travel between the pilot end face and the adjacent annular surface of the flange 108 to expose the inlet water passages 50. When inlet water is to pass into the intensifier high pressure chamber 30 for compression, the force of the inlet water will act against the inner annular surface of the inlet popper 100 and force it away from sealing engagement with the end face of pilot 3 so that water can pass from the inlet water passages 50, around poppet 100 and into the chamber of nose 4 and out through the apertures 110 into the end of the nose cap into the intensifier high pressure chamber 30. During operation of the intensifier, the build-up of water pressure in the compression cycle will cause the inlet poppet 100 to closes against the end face of pilot 3 thereby sealing the water inlet passages 50 to prevent high pressure water form entering the low pressure inlet water system. High pressure water will pass through the apertures of the nose 4 and through the hollow flange 108 and into the guide tube 104 for passage through the valve body. When intensifier operation is stopped, the force of compression spring 106 will cause the inlet poppet to closes to prevent inlet water from flowing back through the valve body.

Figure 3:
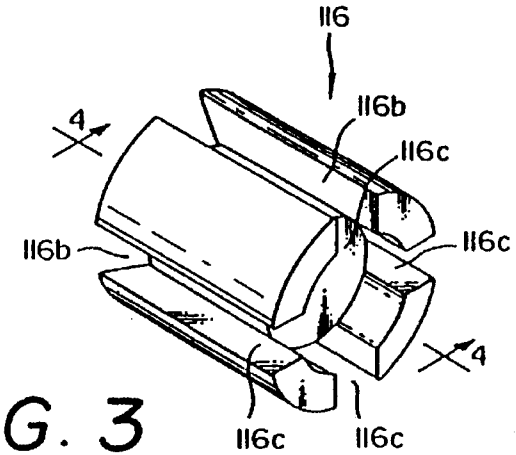
FIG. 3 is a perspective view of the outlet valve ball poppet carrier.
Figure 4:
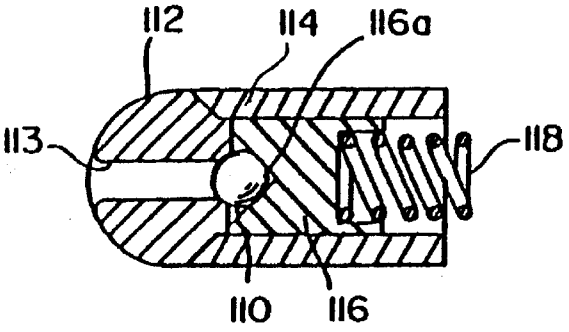
FIG. 4 is a cross section illustrating the relative positions of the outlet valve ball, the outlet valve ball poppet carrier and its sleeve, and the outlet valve ball seat, the view hereof of the outlet valve ball poppet carrier being through lines 4—4 of FIG. 3.

The check valve assembly, as shown in enlarged detail in FIG. 2, and with certain elements further shown in FIGS. 3–4, comprises an outlet ball poppet 110, an outlet poppet valve seat 112, an outlet valve seat retainer sleeve 114, an outlet poppet ball retainer cage 116, and a ball return spring 118. The valve body 24 is machined to provide an axial cylindrical counterbore that terminates in a hemispherical inner end as shown. The ball poppet valve seat 112 is configured with a hemispherical surface at one end to mate with the hemispherical inner end of the valve body counter bore just mentioned. The edge of the opposite end of the ball valve seat 112 is chamfered 45°. The center of the flat surface inside the inner edge of the chamber has a hemispherical seat for the ball poppet. In FIG. 2, the leftward end of the valve seat 112 is hemispherical and the rightward end is flat with the chamfered edge. The outlet ball 110 has a spherical configuration designed to seat within and against the rightward hemispherical surface of the valve seat. The ball valve seat 112 is bored to provide an axial passage 113 communicating with the axial bore 104 through the valve body, bore 104 terminating at the axial base of the valve body hemispherical inner end aforementioned. Valve seat retainer sleeve 114 is a cylindrical sleeve inserted into the valve body counterbore and chamfered to provide a 45° frusto-conical inner edge that bears against the rightward chamfered conical surface of the valve seat 112. Valve seat retainer sleeve 114 is contacted by the inner end of the adapter 58 and forced into engagement with the valve seat 112 so as to retain the valve seat 112 firmly against the hemispherical end of the valve body counterbore with its axial passage 113 aligned with the valve body axial bore 104. The inner edge of the frusto-conical inner end of the valve sear retainer sleeve 114 is coplaner and, consequently, when the retainer is forced against the valve seat frusto-conical surface, any misalignment of the valve seat with respect to the axis of the valve body and its axial bore 104 will be corrected by causing the valve seat 112 to rotate until seated accurately. Since adapter 58 is threaded into the valve body, screwing the adapter into the valve body will automatically force the valve seat 112 to be properly seated in the correct axial attitude. The outlet valve ball retainer cage 116 has a cylindrical configuration with a diameter machined to provide a small allowance between it and the inner surface of the retainer sleeve 114 so that a sliding fit is achieved. The inner end of the cage 116 is machined to provide a conical surface 116a which captures the ball poppet and maintains alignment of the ball poppet 110 with the spherical seat in the rightward end of the seat. The retainer cage 116 is shorter than the passage within which it sets so that a small gap exists between the inner end of adapter 58 and the rightward end of the cage 116. Compression spring 118 fits into axial counterbores in the adjacent ends of the adapter 58 and the cage 116 to urge the cage 116 leftward to force the ball poppet 110 to seat into the recess provided therefor in the rightward end of the valve seat 112. The retainer cage 116 is provided with several longitudinal slots 116*b* in it's outer surface to provide fluid passages between it and the valve seat retainer sleeve 114, and the rightward end of the cage is also slotted to provide radial cross-slots 116*c* connecting with the longitudinal peripheral slots.

When high pressure water reaches a predetermined level, as a result of the compression cycle of the intensifier system, high pressure water flows into the nose cage 4, through its apertures, through the hollow flange 108 and the guide tube 102, axial bores 104 and 113, to force ball poppet 110 away from its valve seat 112 (thereby forcing ball cage 116 rightward until its rightward end contacts the inner end of adapter 58) so that the high pressure water can flow around the ball poppet 110 to the longitudinal slots 116*b* in the periphery of the cage 116, through these slots and through the radial cross slots 116*c* in the end of the cage, and out through the axial passage 54 in adapter 58. When the intensifier compression cycle is completed, back pressure from the water in line 57 will cause ball poppet 110 to re-seat in the ball recess of valve seat 112 and seal off the high pressure water path leftward of that point. when back pressure from line 57 is insufficient to force the ball poppet 110 back onto its seat, as would be the case when the system is shut off and the high pressure water line 57 is drained, the force of compression spring 118 will re-seat the ball poppet so that low pressure water will not flow from the inlet line 58, through the valve body inlet passages 50 into the nose 4 and then be detoured and flow back through the inlet passages 102, 104, and 54 to outlet line 57.

Of the two poppet sealing surfaces, the sealing surfaces associated with the ball outlet poppet 110 incur much more sever stress. This stress is debilitating and can causes premature failure of the valve seat 112, the ball poppet 110 or the retainer cage 116. This stress on the valve seat 112 is considerably minimized by the provision of the valve seat retainer 114 being wedged against the valve seat when the adapter 58 is screwed into position as aforementioned. This relationship of the chamfered edge of the retainer 114 bearing against the chamfered surface of the seat 112, creates a compression stress field within the seat 112 which minimizes the possibility of a fatigue failure within the seat. This is so because the compression stress thus created will cause the maximum value of the cyclic stress fluctuation, caused by fluctuating water pressures, to remain below the endurance limit of the material of the seat 112.

To summarize:

Incoming low pressure water enters the manifold 55, passes through the angled passages 50 through the body 24, unseating the low pressure poppet 100 against the spring force of spring 106, passes through the annular area between the inside bore of the nose 4 and the outside of the poppet 100, and out through the holes in the end of the nose into the high pressure barrel chamber 30. The high pressure fluid in the outlet passage 57 maintains sealing between the ball poppet 110 and the sealing seat 112 during charging of the high pressure barrel chamber.

Upon reversal of the high pressure piston 31, increased fluid pressure seats the low pressure poppet 100 against the common surfaces of the body 24 and unseats the ball poppet 110 from its seat 112 against the decaying fluid system pressure and pumps the high pressure fluid past the ball poppet 110, ball carrier 116, spring 118, and through the outlet adapter 58.

Upon reversal of the high pressure piston 31 again, the ball poppet 110 seats in its spherical seat 112 and high pressure water at system pressure is prevented from back flowing into the valve. Downstream of the adapter 58, whatever use is made of the high pressure water will deplete the flow and the system pressure downstream will gradually decay. Thus, spring 118 acts through ball carrier 116 to keep ball poppet 110 seated, while low pressure water is directed into the high pressure barrel chamber 30 as described above.

When the outlet valve mechanism requires servicing, the adapter 58 is unscrewed and removed. The, the spring 118, ball poppet retainer 116, ball poppet 110, valve seat retainer sleeve 114, and the valve seat 112 may be removed and polished, resurfaced or replaced, as may be required. These high pressure outlet valve elements are the most likely to require periodic maintenance. When reinserted, the hemispherical surfaces of the valve seat cavity and the valve seat itself facilitate the automatic alignment of the valve seat 112 so that the valve seat passage 113 and the valve body passage 104 are exactly aligned. When the valve seat retainer 114 is positioned and the adapter 58 screwed back into position, the valve seat 12 must align properly, automatically, because the frusto-conical edge of the valve seat retainer 114 will force realignment until it uniformly contacts the chamfered surface of the valve seat 112.

If the inlet valve mechanism requires servicing, the intensifier assembly end cap 12, 12*a* is unscrewed and removed, after removing the six preload bolts 59. Then, the valve body 24, 24*a* can be removed and the nose 4 can be unscrewed to expose the inlet valve elements.

While the preferred embodiment of the invention has been described herein, variations in the design may be made. The scope of the invention, therefore, is only to be limited by the claims appended hereto.

The embodiments of the invention in which an exclusive property is claimed are defined as follows:

1. A fluid pressure-intensifying apparatus which comprises:

a) a low pressure-high pressure cylinder means comprising a low pressure cylinder providing a cylindrical low pressure chamber and a pair of high pressure cylinders providing a pair of elongated cylindrical high pressure chambers, the high pressure chambers extending from opposite ends of said low pressure chamber and each having an inner end proximal to the low pressure chamber and an outer end distal to the low pressure chamber; low pressure-high pressure piston means having a double acting low pressure piston section mounted for reciprocal movement in said low pressure chamber, and having a pair of elongated high pressure piston sections each connected to an opposite side of said low pressure piston section and extending from said low pressure chamber into an adjacent one of said high pressure chambers for reciprocal movement therein;

b) and a pair of fluid inlet-outlet means each communicating with a corresponding one of said high pressure chambers and comprising a check valve body having a first portion fitted into the outer end of a corresponding one of said high pressure cylinders and a second portion so mounted that the outer end of said corresponding high pressure cylinder is maintained in alignment with said low pressure cylinder, said valve body being provided with a longitudinal axial fluid passage opening at one end for fluid communication with said corresponding high pressure chamber and opening at the other end into a cavity provided in a high pressure outlet line coupling; a low pressure fluid inlet distributor mounted adjacent to said valve body, with said valve body being provided with an elongated inlet fluid passage opening at one end for fluid communication with said corresponding high pressure chamber and opening at the other end into said low pressure fluid inlet distributor, said inlet fluid passage extending acutely outward through said valve body from its inner end to its outer end; an inlet valve mechanism for said valve body comprising an elongated guide tube extending into said axial fluid passage and extending out from the inner end of said valve body and providing fluid communication between said corresponding high pressure chamber and the interior of said axial passage, and further comprising an inlet poppet slidable mounted on the inner end of said guide tube and being so configured as to overlay and seal off the inner end of the inlet fluid passage opening when the force exerted by fluid from a high pressure fluid chamber exceeds the force exerted by inlet fluid within said inlet fluid passage; and an outlet valve mechanism for said valve body comprising a valve seat element fitted into a valve seat cavity provided therefor in said valve body, said valve seat element having a fluid passage therethrough oriented in fluid communication with said valve body axial fluid passage and having a hemispherical valve seat provided in an end of the valve seat fluid passage remote from the valve body axial fluid passage, a ball poppet seatable within the valve seat to seal off the valve seat fluid passage, a ball retainer element positioned within a retainer cavity provided therefor in said valve body and being configured at an inner end to contact said ball poppet to seat the ball poppet on the valve seat and being further configured to permit fluid to pass through said valve body axial passage to an outlet line coupling when the ball poppet is forced off the valve seat by fluid pressure build up in said corresponding high pressure chamber.

2. The apparatus of claim 1 wherein the outlet valve mechanism of each fluid inlet-outlet means includes a return spring positioned to so act on said ball retainer element whereby said ball poppet is urged toward the valve seat provided for said ball poppet.

3. The apparatus of claim 1 including a housing cylinder enclosing said low pressure-high pressure cylinder means and having threaded end sections, and a pair of threaded end retainers each provided with a bore in which one of said valve bodies is fitted, each end retainer being so constructed and arranged to compressively engage an adjacent valve body with a corresponding one of said high pressure cylinders, when said end retainers are screwed to said housing cylinder, with sufficient force to hold together and position said valve bodies and said high and low pressure cylinders under operating conditions.

4. The apparatus of claim 1 wherein the inlet valve mechanism of each fluid inlet-outlet means includes a cap extending from the inner end of said valve body for fluid communication with said corresponding high pressure chamber, said inlet poppet for said fluid inlet-outlet means being contained within said cap, and said fluid inlet-outlet means further comprising a return spring extending between said cap and said inlet poppet to urge said inlet poppet into position to seal off the inner end of the inlet fluid passage.

5. The apparatus of claim 4 wherein the guide tube of each fluid inlet-outlet means is provided with a flange configured to limit the distance of travel of said inlet poppet, said flange having a longitudinal fluid passage therethrough in communication with the interior of said guide tube.

6. The apparatus of claim 1 wherein each fluid inlet-outlet means includes a high pressure outlet line coupling mountable to said valve body, said coupling having an inner cavity in fluid communication with said retainer cavity; and wherein said outlet valve mechanism includes a cylindrical valve seat retainer element extending through the valve body retainer cavity and contacting said valve seat such that said coupling, when mounted to said valve body, causes said retainer element to force said valve seat into position in the valve seat cavity provided therefor in said valve body with the valve seat fluid passage aligned with said valve body axial passage.

7. The apparatus of claim 6 wherein the outlet valve mechanism of each fluid inlet-outlet means includes a return spring positioned between said coupling and said ball retainer element to so act on said ball retainer element whereby said ball poppet is urged toward the valve seat provided for said ball poppet.

8. The apparatus of claim 6 wherein the inlet valve mechanism of each fluid inlet-outlet means includes a cap extending from the inner end of said valve body for fluid communication with said corresponding high pressure chamber, said inlet poppet being contained within said cap, and further includes a return spring extending between said cap and said inlet poppet to urge said inlet poppet into position to seal off the inner end of the inlet fluid passage.

9. The apparatus of claim 1 wherein the valve seat element of each fluid inlet-outlet means is provided with a chamfered edge at the end that contains said hemispherical valve seat and is remote from the valve body axial fluid passage; and wherein said ball retainer element comprises a solid cylinder provided with longitudinal slots in its periphery, and further provided with a chamfered conical recess in its inner end adjacent the valve seat chamfered edge, said chamfered recess being so configured whereby said solid cylinder may overlay said ball poppet with the surface defining its chamfered recess contacting the surface of said ball poppet.

10. The apparatus of claim 9 wherein each fluid inlet-outlet means includes a high pressure outlet line coupling mountable to said valve body, said coupling having an inner cavity in fluid communication with said retainer cavity; and wherein said outlet valve mechanism includes a cylindrical valve seat retainer element extending through the valve body retainer cavity and contacting said valve seat such that said coupling when mounted to said valve body, causes said retainer element to force said valve seat into position in the valve seat cavity provided therefor in said valve body with the valve seat fluid passage aligned with said valve body axial passage.

11. The apparatus of claim 9 wherein the outlet valve mechanism of each fluid inlet-outlet means includes a return spring positioned between said coupling and said ball retainer element to so act on said ball retainer element whereby said ball poppet is urged toward the valve seat provided for said ball poppet.

12. The apparatus of claim 9 wherein the inlet valve mechanism of each fluid inlet-outlet means includes a cap extending from the inner end of said valve body for fluid communication with said corresponding high pressure chamber, said inlet poppet being contained within said cap, and further including a return spring extending between said cap and said inlet poppet to urge said inlet poppet into position to seal off the inner end of the inlet fluid passage.

13. The apparatus of claim 12 wherein the guide tube of each fluid inlet-outlet means is provided with a flange configured to ensure planer contact between the sealing surface of the inlet poppet and that of the valve body.

14. The apparatus of claim 1 wherein one of said threaded retainers comprises a retainer ring in abutting contact with the adjacent end of said housing cylinder, and a preload ring adjustably-bolted to said retainer ring, said preload ring being provided with one of the aforesaid bores in which one of said valve bodies is fitted whereby as said preload ring is snugged toward said retainer ring the aforesaid compressive force is applied to hold and position the intensifier elements under operating conditions.

15. The apparatus of claim 14 wherein the outlet valve mechanism of each fluid inlet-outlet means includes a return spring positioned to so act on said ball retainer element whereby said ball poppet is urged toward the valve seat provided for said ball poppet.

16. The apparatus of claim 14 wherein the inlet valve mechanism of each fluid inlet-outlet means includes a cap extending from the inner end of said valve body for fluid communication with said corresponding high pressure chamber, said inlet poppet for said fluid inlet-outlet means being contained within said cap, and said fluid inlet-outlet means further comprising a return spring extending between said cap and said inlet poppet to urge said inlet poppet into position to seal off the inner end of the inlet fluid passage.

17. The apparatus of claim 16 wherein the guide tube of each fluid inlet-outlet means is provided with a flange configured to limit the distance of travel of said inlet poppet, said flange having a longitudinal fluid passage therethrough in communication with the interior of said guide tube.

18. The apparatus of claim 14 wherein each fluid inlet-outlet means includes a high pressure outlet line coupling mountable to said valve body, said coupling having an inner cavity in fluid communication with said retainer cavity; and wherein said outlet valve mechanism includes a cylindrical valve seat retainer element extending through the valve body retainer cavity and contacting said valve seat such that said coupling, when mounted to said valve body, causes said retainer element to force said valve seat into position in the valve seat cavity provided therefor in said valve body with the valve seat fluid passage aligned with said valve body axial passage.

19. The apparatus of claim 18 wherein the outlet valve mechanism of each fluid inlet-outlet means includes a return spring positioned between said coupling and said ball retainer element to so act of said ball retainer element whereby said ball poppet is urged toward the valve seat provided for said ball poppet.

20. The apparatus of claim 14 wherein the valve seat element of each fluid inlet-outlet means is provided with a chamfered edge at the end that contains said hemispherical valve seat and is remote from the valve body axial fluid passage; and wherein said ball retainer element comprises a solid cylinder provided with longitudinal slots in its periphery, and further provided with a chamfered conical recess in its inner end adjacent the valve seat chamfered edge, said chamfered recess being so configured whereby said solid cylinder may overlay said ball poppet with the surface defining its chamfered recess contacting the surface of said ball poppet.

21. The apparatus of claim 20 wherein each fluid inlet-outlet means includes a high pressure outlet line coupling mountable to said valve body, said coupling having an inner cavity in fluid communication with said retainer cavity; and wherein said outlet valve mechanism includes a cylindrical valve seat retainer element extending through the valve body retainer cavity and contacting said valve seat such that said coupling, when mounted to said valve body, causes said retainer element to force said valve seat into position in the valve seat cavity provided therefor in said valve body with the valve seat fluid passage aligned with said valve body axial passage.

22. The apparatus of claim 21 wherein the outlet valve mechanism of each fluid inlet-outlet means includes a return spring positioned between said coupling and said ball retainer element to so act on said ball retainer element whereby said ball poppet is urged toward the valve seat provided for said ball poppet.

23. Fluid inlet-outlet means for mounting in fluid communication with a high pressure chamber of a reciprocating piston cylinder, said fluid inlet-outlet means comprising a check valve body having a first portion fitted into an outer end of an adjacent high pressure cylinder and a second portion so mounted that the outer end of the adjacent high pressure cylinder is maintained in alignment with a low pressure cylinder, said valve body being provided with a longitudinal axial fluid passage opening at one end for fluid communication with a high pressure piston chamber provided by said high pressure cylinder and opening at the other end into a cavity provided in a high pressure outlet line coupling; a low pressure fluid inlet distributor mounted adjacent to said valve body, with said valve body being provided with an elongated inlet fluid passage opening at an inner end for fluid communication with said high pressure piston chamber and opening at an outer end into said low pressure fluid inlet distributor, said inlet fluid passage extending acutely outward through said valve body from an inner end to an outer end; an inlet valve mechanism for said valve body comprising an elongated guide tube extending into said axial fluid passage and extending outward from the inner end of said valve body and providing fluid communication between said high pressure piston chamber and the interior of said axial passage, and further comprising an inlet poppet slidably mounted on an inner end of said guide tube and being so configured as to overlay and seal off the inner end of the inlet fluid passage when the force exerted by fluid from said high pressure piston chamber exceeds the force exerted by inlet fluid within said inlet fluid passage; and an outlet valve mechanism for said valve body comprising a valve seat element fitted into a valve seat cavity provided therefor in said valve body, said valve seat element having a fluid passage therethrough oriented in fluid communication with said valve body axial fluid passage and having a hemispherical valve seat provided in an end of the valve seat fluid passage remote from the valve body axial fluid passage, a ball poppet seatable within the valve seat to seal off the valve seat fluid passage, a ball retainer element positioned within a retainer cavity provided therefor in said valve body and being configured at an inner end thereof to contact said ball poppet to seat the ball poppet on the valve seat and being further configured to permit fluid to pass through said valve body axial passage to an outlet line coupling when the ball poppet is forced off the valve seat by fluid pressure build up in said high pressure chamber.

24. The apparatus of claim 23 wherein the outlet valve mechanism of said fluid inlet-outlet means includes a return spring positioned to so act on said ball retainer element whereby said ball poppet is urged toward the valve seat provided for said ball poppet.

25. The apparatus of claim 23 wherein the inlet valve mechanism of said fluid inlet-outlet means includes a cap extending from the inner end of said valve body for fluid communication with said high pressure chamber, said inlet poppet for said fluid inlet-outlet means being contained within said cap, and said fluid inlet-outlet means further comprising a return spring extending between said cap and said inlet poppet to urge said inlet poppet into position to seal off the inner end of the inlet fluid passage.

26. The apparatus of claim 22 wherein the guide tube of said fluid inlet-outlet means is provided with a flange configured to limit the distance of travel of said inlet poppet, said flange having a longitudinal fluid passage therethrough in communication with the interior of said guide tube.

27. The apparatus of claim 23 wherein each fluid inlet-outlet means includes a high pressure outlet line coupling mountable to said valve body, said coupling having an inner cavity in fluid communication with said retainer cavity; and wherein said outlet valve mechanism includes a cylindrical valve seat retainer element extending through the valve body retainer cavity and contacting said valve seat such that said coupling, when mounted to said valve body, causes said retainer element to force said valve seat into position in the valve seat cavity provided therefor in said valve body with the valve seat fluid passage aligned with said valve body axial passage.

28. The apparatus of claim 27 wherein the outlet valve mechanism of said fluid inlet-outlet means includes a return spring positioned between said coupling and said ball retainer element to so act on said ball retainer element whereby said ball poppet is urged toward the valve seat provided for said ball poppet.

29. The apparatus of claim 27 wherein the inlet valve mechanism of said fluid inlet-outlet means includes a cap extending from the inner end of said valve body for fluid communication with said high pressure chamber, said inlet poppet being contained within said cap, and further includes a return spring extending between said cap and said inlet poppet to urge said inlet poppet into position to seal off the inner end of the inlet fluid passage.

30. The apparatus of claim 23 wherein the valve seat element of each fluid inlet-outlet means is provided with a chamfered edge at its end that contains said hemispherical valve seat and remote from the valve body axial fluid passage; and wherein said ball retainer element comprises a solid cylinder provided with longitudinal slots in its periphery, and further provided with a chamfered conical recess in an inner end adjacent to the valve seat chamfered edge, said chamfered recess being so configured whereby said solid cylinder may overlay said ball poppet with the surface defining its chamfered recess contacting the surface of said ball poppet.

31. The apparatus of claim 30 wherein each fluid inlet-outlet means includes a high pressure outlet line coupling mountable to said valve body, said coupling having an inner cavity in fluid communication with said retainer cavity; and wherein said outlet valve mechanism includes a cylindrical valve seat retainer element extending through the valve body retainer cavity and contacting said valve seat such that said coupling, when mounted to said valve body, causes said retainer element to force said valve seat into position in the valve seat cavity provided therefor in said valve body with the valve seat fluid passage aligned with said valve body axial passage.

32. The apparatus of claim 30 wherein the outlet valve mechanism of said fluid inlet-outlet means includes a return spring positioned between said coupling and said ball retainer element to so act on said ball retainer element whereby said ball poppet is urged toward the valve seat provided for said ball poppet.

33. The apparatus of claim 30 wherein the inlet valve mechanism of said fluid inlet-outlet means includes a cap extending from the inner end of said valve body for fluid communication with said high pressure chamber, said inlet poppet being contained within said cap, and further including a return spring extending between said cap and said inlet poppet to urge said inlet poppet into position to seal off the inner end of the inlet fluid passage.

34. The apparatus of claim 33 wherein the guide tube of said fluid inlet-outlet means is provided with a flange configured to ensure planer contact between the sealing surface of the low pressure poppet and that of the valve body.

* * * * *